US010415774B2

(12) United States Patent
Loates

(10) Patent No.: US 10,415,774 B2
(45) Date of Patent: Sep. 17, 2019

(54) LIGHTED LAMP FRAME DEVICE AND METHOD

(71) Applicant: Michael Loates, North York (CA)

(72) Inventor: Michael Loates, North York (CA)

( * ) Notice: Subject to any disclaimer, the term of this patent is extended or adjusted under 35 U.S.C. 154(b) by 29 days.

(21) Appl. No.: 15/444,897

(22) Filed: Feb. 28, 2017

(65) Prior Publication Data

US 2018/0245768 A1 Aug. 30, 2018

(51) Int. Cl.

| | |
|---|---|
| ***F21S 6/00*** | (2006.01) |
| ***F21V 21/06*** | (2006.01) |
| ***G09F 13/00*** | (2006.01) |
| ***F21S 9/02*** | (2006.01) |
| ***F21Y 103/10*** | (2016.01) |
| ***F21Y 115/10*** | (2016.01) |
| ***F21W 121/00*** | (2006.01) |
| ***F21Y 113/20*** | (2016.01) |

(52) U.S. Cl.

CPC ..... *F21S 6/002* (2013.01); *F21V 21/06* (2013.01); *G09F 13/00* (2013.01); *F21S 9/02* (2013.01); *F21W 2121/00* (2013.01); *F21Y 2103/10* (2016.08); *F21Y 2113/20* (2016.08); *F21Y 2115/10* (2016.08)

(58) Field of Classification Search

CPC .... F21V 1/02; F21V 11/00; F21V 1/08; F21S 6/003; F21S 6/002; F21S 10/023; F21Y 2115/10; F21Y 2103/10; F21W 2121/00

See application file for complete search history.

(56) References Cited

U.S. PATENT DOCUMENTS

| | | | | |
|---|---|---|---|---|
| 1,863,607 | A * | 6/1932 | Sabath | F21S 6/002 362/412 |
| 2,638,533 | A | 5/1953 | Zobian | |
| 5,598,652 | A * | 2/1997 | Nurre | G09F 13/00 362/412 |
| 6,113,249 | A * | 9/2000 | Ziegler | A47G 1/14 362/253 |
| 6,206,536 | B1 | 3/2001 | Lin | |
| 6,802,143 | B1 * | 10/2004 | Rachowitz | G09F 15/0081 40/473 |
| 8,146,216 | B2 | 4/2012 | Creager | |
| 9,416,922 | B1 * | 8/2016 | Stagni | H05B 33/0845 |
| 10,001,255 | B2 * | 6/2018 | Minsky | F21V 1/26 |
| 2003/0202340 | A1 * | 10/2003 | Wu | F21S 6/002 362/101 |
| 2010/0202146 | A1 | 8/2010 | Gobindram | |
| 2011/0193482 | A1 | 8/2011 | Jones | |

(Continued)

*Primary Examiner* — Peggy A Neils

(74) *Attorney, Agent, or Firm* — Integrity Patent Group, PLC; Charles E. Runyan

(57) ABSTRACT

A lighted lamp frame device including a frame, the frame including a front, a back, a top, a bottom and two sides with each of the two sides including a channel, with the top including a neck configured to hold a first-light-source. Included is at least one piece of glass removably contained within the channel of the frame, and at least one light strip contained within the channel of the frame to provide a second-light-source to illuminate the at least one piece of glass. A power supply electrically is coupled to the light strip via a wire-assembly, a base removably coupled to the frame, and a lamp shade removably coupled to the device to provide a cover for the first-light-source.

15 Claims, 5 Drawing Sheets

(56) References Cited

U.S. PATENT DOCUMENTS

| | | | | |
|---|---|---|---|---|
| 2012/0239521 | A1* | 9/2012 | Acworth | F21S 6/002 705/26.5 |
| 2014/0268636 | A1* | 9/2014 | Yang | F21S 6/002 362/84 |

* cited by examiner

LIGHTED LAMP FRAME DEVICE AND METHOD

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

1. Field of the Invention

The present invention relates generally to the field of illumination and more specifically relates to illumination within a container.

2. Description of Related Art

A light fixture or lamp is generally a device used to create artificial light by use of an electrical source Lamps generally have a body and a socket to hold the bulb and allow for replacement. Lamps may also have a switch (or switches if there are multiple light sources) to control the light source. Lamps require an electrical connection to a power supply, where permanent lighting may be directly wired; moveable lamps have a plug, or a battery power supply. Light fixtures may include additional features, such as reflectors for directing/focusing light, apertures, and/or lenses Lamps and light fixtures may be specialized in their applications.

Engraving is the practice of imprinting a design onto a hard surface by cutting grooves into it. Engraving may be achieved by many means, such as by a cutting tool, stamping, or the use of lasers or other devices. Engraving may include placing the design upon the surface of a flat object or by imprinting the design within a three-dimensional object. Such three-dimensional objects may include glass or other opaque or transparent materials.

In most cases, lamps are used to simply provide a light source with little aesthetic value. It is desired to provide a lamp that includes the ability to illuminate and display images and/or text. Therefore a suitable solution is desired.

Portable light fixtures are often called "lamps", as in a table lamp or desk lamp. In technical terminology, the lamp is the light source, which is typically called the light bulb. U.S. Pat. No. 2,638,533 to James G. Zobian relates to a stand lamp having an illuminated base. The invention relates to an illuminated base lamp, which is illuminated interiorly; a main or upper lamp is supported by the illuminated base, safe manner to enable its ready removal for the purpose of changing the bulb in the base or for the purpose of replacing illuminated pictorial representations which are carried by the base. The arrangement is controlled by a three-way switch whereby either the upper or lower lamp may be lighted, both lamps may be lighted, or both lamps may be de-energized. If the transparent or translucent sides of the base are in the form of pictorial representations, such as photographic-slides either in black and white or in color, or other scenes shown on translucent parchment, paper, ground glass, or the like.

BRIEF SUMMARY OF THE INVENTION

In view of the foregoing disadvantages inherent in the known illumination with a container art, the present disclosure provides a novel a lighted lamp frame device and method. The general purpose of the present disclosure, which will be described subsequently in greater detail, is to provide a lighted lamp frame device and method.

A lighted lamp frame device is disclosed herein. The lighted lamp frame device includes a frame, with the frame including a front, a back, a top, a bottom, and two sides; with each of the two sides including a channel, with the top including a neck configured to hold a first-light-source.

Also included is at least one piece of glass removably contained within the channel of the frame, and at least one light strip contained within the channel of the frame to provide a second-light-source to illuminate the at least one piece of glass. The term glass may include a non-shatterable glass or similar transparent material.

Additionally included is a power supply electrically coupled to the light strip via a wire-assembly, a base removably coupled to the frame, and a lamp shade removably coupled to the device to provide a cover for the first-light-source.

According to another embodiment, a method of using a lighted lamp frame device is also disclosed herein. The method of use includes a first step, providing a lighted lamp frame device (including at least one piece of glass, with the at least on piece of glass including an image); a second step, providing a power supply; a third step, placing the at least one piece of glass within a frame of the lighted lamp frame device; a fourth step, illuminating the lighted lamp frame device to display the image; a fifth step, deluminating the lighted lamp frame device; a sixth step, removing the at least one piece of glass; and a seventh step, replacing the at least one piece of glass.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, a lighted lamp frame device and method, constructed and operative according to the teachings of the present disclosure.

The various embodiments of the present invention will hereinafter be described in conjunction with the appended drawings, wherein like designations denote like elements.

DETAILED DESCRIPTION

As discussed above, embodiments of the present disclosure relate to illumination within a container and more particularly to a lighted lamp frame device and method as used to improve the display of images and information within a lighted lamp frame.

Generally, a lighted lamp frame device provides lighting to show on the sides illuminating three-dimensional art or objects inside, and provides a clear image that the viewer may appreciate. The device is operable via a switch, that may be three-way as follows: base "ON", base and lamp "ON", base "OFF" with lamp "ON". The lamp may also, or alternatively, include text messages, such as advertising. The lamp may be utilized in many industries (e.g., hotels, restaurants, etc.) to promote branding and/or improve aesthetics. Objects may additionally include (but not be limited to) sculptures, figures, statues, or other solid objects.

Figure 1:
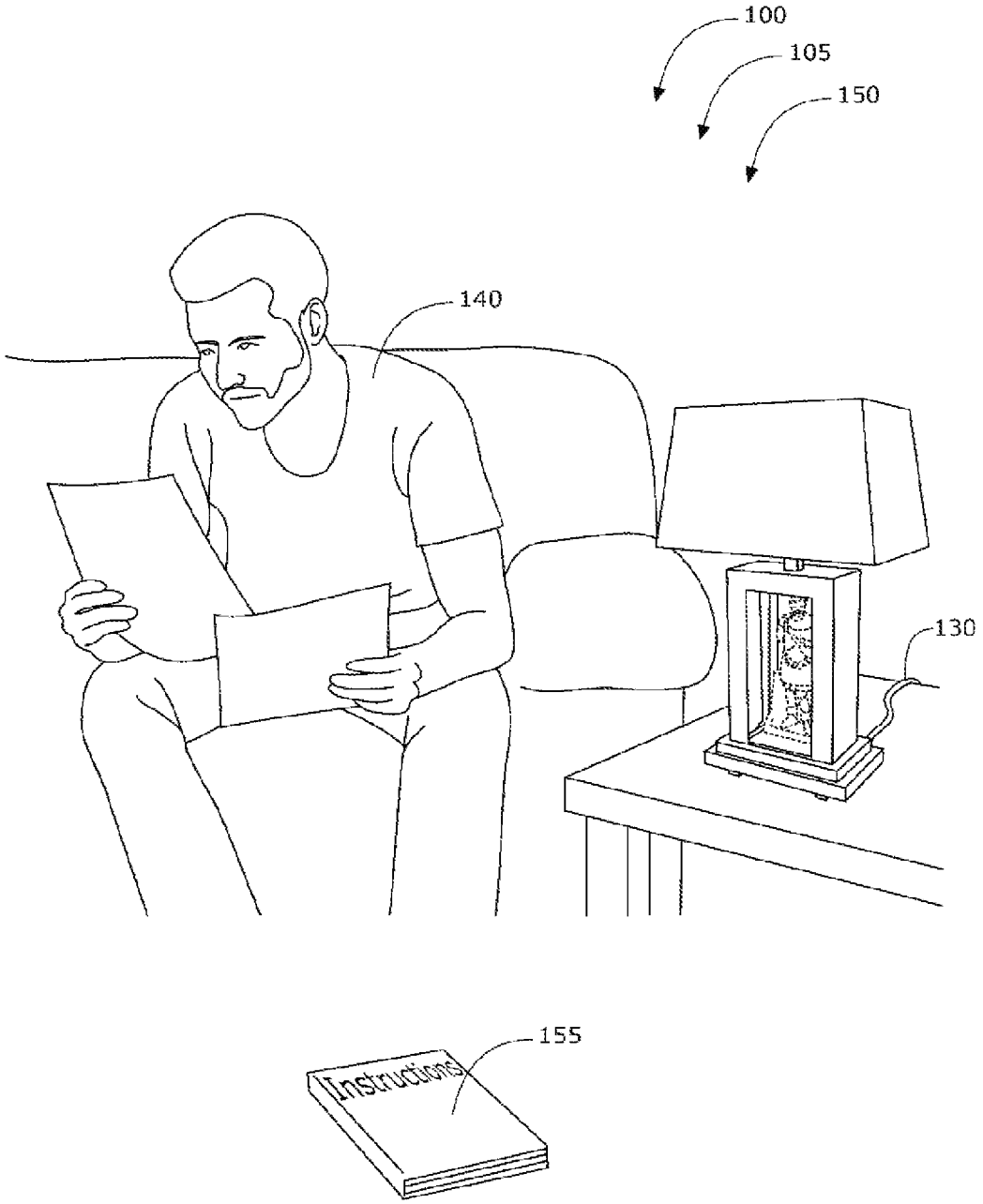
FIG. 1 is a perspective view of the lighted lamp frame device during an 'in-use' condition, according to an embodiment of the disclosure.

Referring now more specifically to the drawings by numerals of reference, there is shown in FIGS. 1-4, various views of a lighted lamp frame device 100. FIG. 1 shows a lighted lamp frame device during an 'in-use' condition 150, according to an embodiment of the present disclosure. Here, the lighted lamp frame device 100 may be beneficial for use by a user 140 to provide illumination with the capability to also display image(s) 145 in two or three dimensions as well as the ability to display text, or illuminate one or more objects (e.g., sculptures, pottery, etc.). As illustrated, the lighted lamp frame device 100 may include frame 110, at least one piece of glass 120, at least one light strip 125, power supply 130, base 146, and lamp shade 135. In some embodiments, the lamp shade may not be required. The at least one piece of glass 120 may include panels, panes, glass blocks, or other embodiments depending upon user preferences and specific applications. Also, the term 'glass' may also include any transparent material (e.g., plastics, transparent ceramics, etc.)

According to one embodiment, the lighted lamp frame device 100 may be arranged as a kit 105. In particular, the lighted lamp frame device 100 may further include a set of instructions 155. The instructions 155 may detail functional relationships in relation to the structure of the lighted lamp frame device 100 (such that the lighted lamp frame device 100 can be used, maintained, or the like, in a preferred manner).

Figure 2:
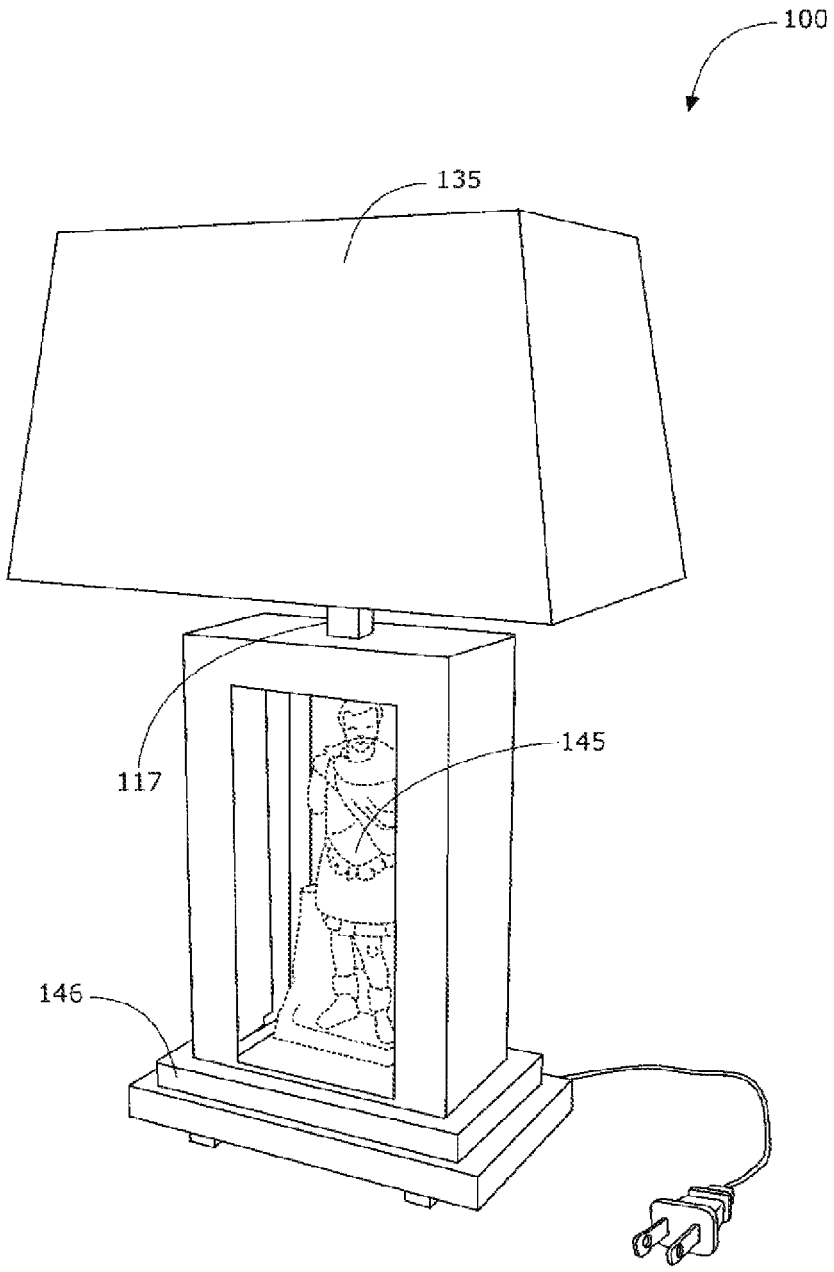
FIG. 2 is a front perspective view of the lighted lamp frame device of FIG. 1, according to an embodiment of the present disclosure.

FIG. 2 shows the lighted lamp frame device 100 of FIG. 1, according to an embodiment of the present disclosure. As above, the lighted lamp frame device 100 may include frame 110, at least one piece of glass 120, at least one light strip 125, power supply 130, and base 146 removably coupled to frame 110, lamp shade 135. At least one piece of glass 120 may include any type of glass (e.g., glass panels, glass panes, glass block, hollow glass block, etc.). Also the term 'glass' may include plastic materials that resemble and/or include properties that can may be found in traditional glass materials and are not limited to silicates nor non crystalline solids.

Figure 3:
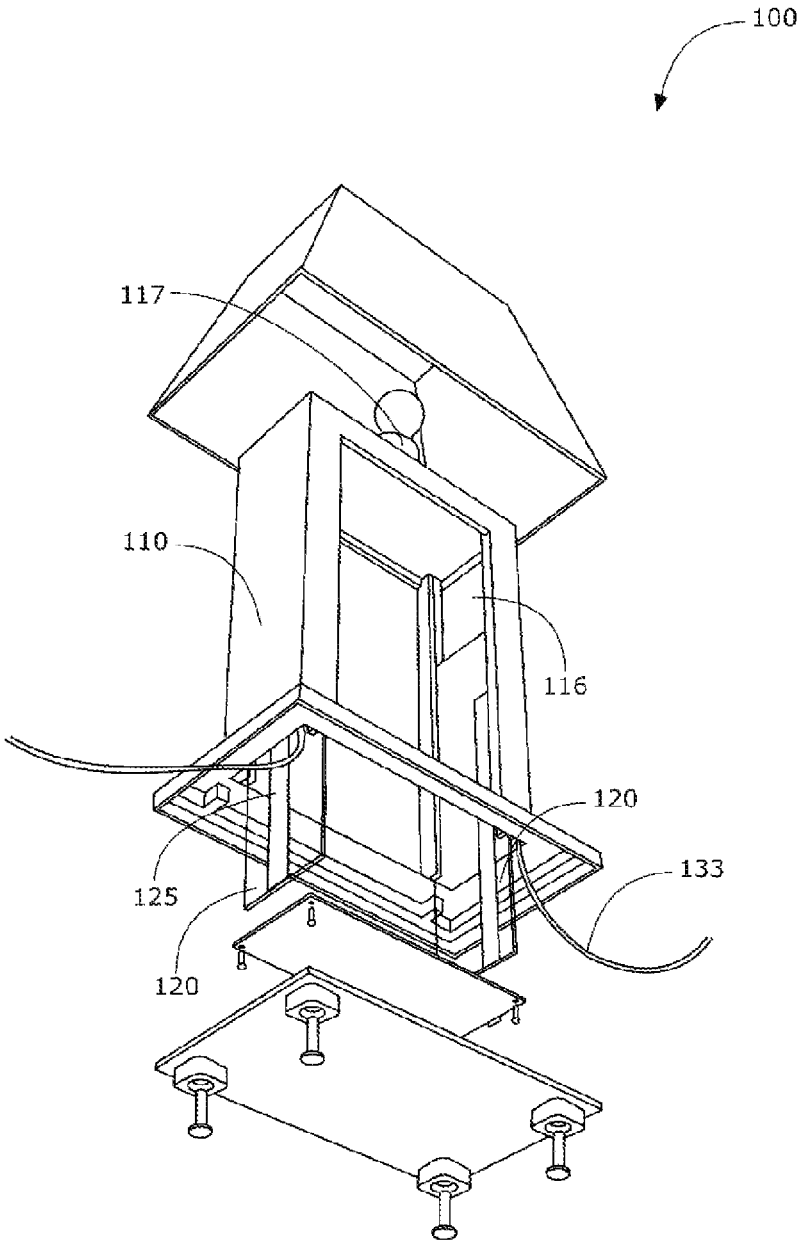
FIG. 3 is a top exploded view of the lighted lamp frame device of FIG. 1, according to an embodiment of the present disclosure.
Figure 4:
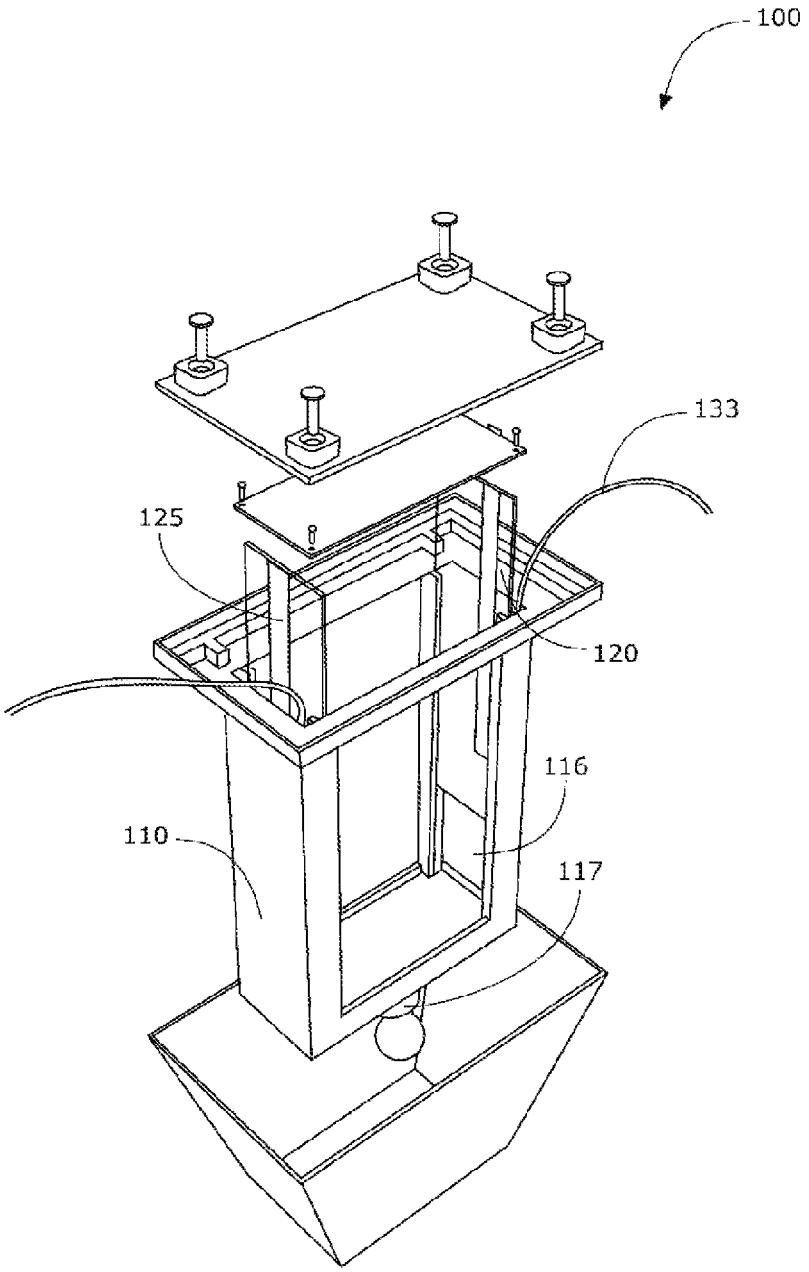
FIG. 4 is a bottom exploded view of the lighted lamp frame device of FIG. 1, according to an embodiment of the present disclosure.

FIG. 3 is a bottom exploded view of lighted lamp frame device 100 of FIG. 1, whereas FIG. 4 is a top exploded view of lighted lamp frame device of FIG. 1, according to embodiments of the present disclosure. As shown, frame 110 may include a front, a back, a top, a bottom and two sides, with each of two sides including channel 116, with the top including neck 117 configured to hold a first-light-source, with at least one piece of glass 120 removably contained into channel 116 of frame 110. Some embodiments may not be required to hold a first-light-source such that top would not include neck 117 and therefore would also not include lamps shade 135.

As shown in FIG. 3 and FIG. 4, at least one light strip 125 may be contained within channel 116 of frame 110 to provide a second-light-source to illuminate at least one piece of glass 120. Each of at least one piece of glass 120 may include image 145. Image 145 may comprise a two-dimensional image, a three-dimensional image, and/or a sculpture, figure, etc., in embodiments. Each of two-dimensional image and three-dimensional image may be placed upon glass 120 via sub-surface engraving. Further, glass 120 may be constructed from a shatter-resistant material to provide safety and durability during use. Also, glass 120 two-dimensional image may comprise written functional text. Some embodiments may include base 146 coupled to the bottom of frame 110. Glass 120 may include a texture, coating, or similar surface or treatment to diffuse or modify light.

Power supply 130 may be electrically coupled to light strip 125 via wire-assembly 133 and lamp shade 135 may be removably coupled to device 100 to provide a cover for the first-light-source. In embodiments, power supply 130 may comprise a DC battery or an AC power source, a combination thereof, or the ability to operate on each. Light strip 125 may comprise LED lights, such as in an LED light strip 125. Also, the (LED) light strip 125 may be operated by a circuit board. In embodiments including a circuit board, (LED) light strip 125 may be programmable via the circuit board to provide predetermined lighting patterns. In embodiments, first-light-source may be operable independent of the second-light-source, and/or may be operable in conjunction with the second-light-source.

Figure 5:
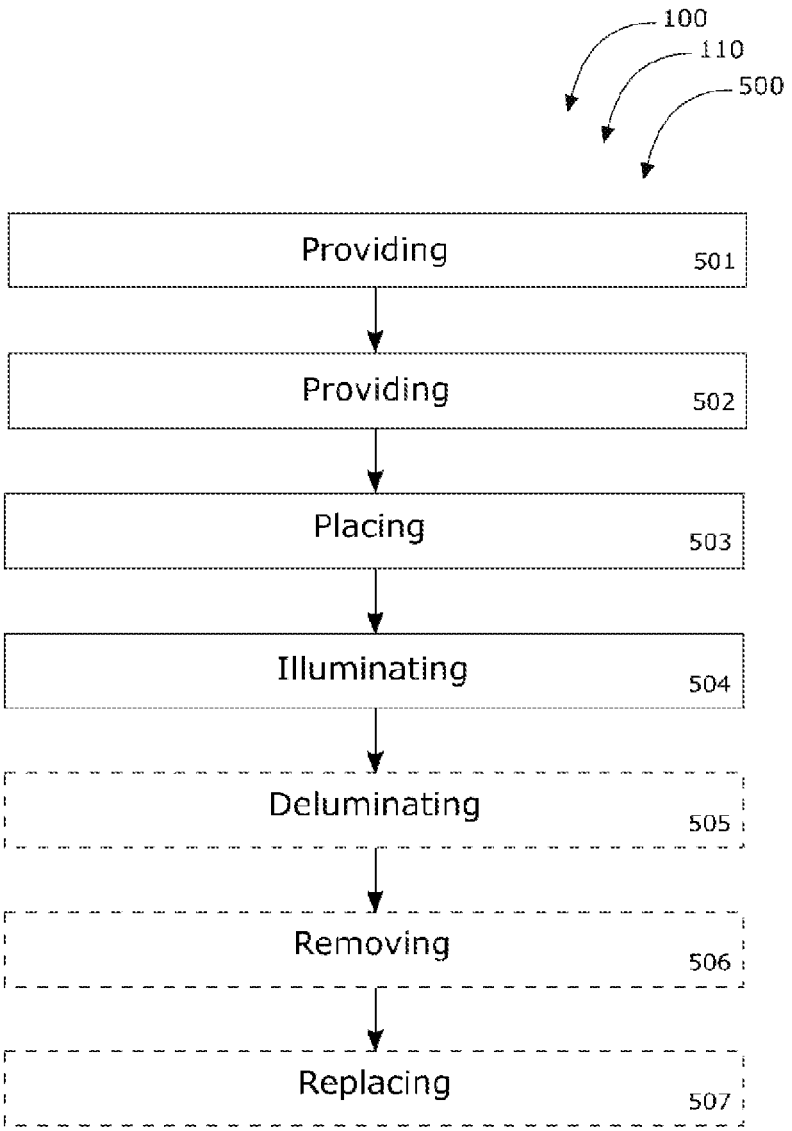
FIG. 5 is a flow diagram illustrating method of using a lighted lamp frame device, according to an embodiment of the present disclosure.

FIG. 5 is a flow diagram illustrating a method of using lighted lamp frame device 100, according to an embodiment of the present disclosure. In particular, the method of using lighted lamp frame device 500 may include one or more components or features of the lighted lamp frame device 100 as described above. As illustrated, the method for method of using a lighted lamp frame device 500 may include the steps of: step one 501, providing lighted lamp frame device 100 (including at least one piece of glass 120, with at least one piece of glass 120 including image 145); step two 502, providing power supply 130; step three 503, placing the at least one piece of glass 120 within frame 110 of lighted lamp frame device 100; step four 504, illuminating lighted lamp frame device 100 to display image 145; step five 505, deluminating lighted lamp frame device 100; step six 506, removing at least one piece of glass 120; and step seven 507, replacing at least one piece of glass 120 with an alternate piece of glass containing a different image 145 and/or text.

It should be noted that step five 505, step six 506, and step seven 507 are optional steps and may not be implemented in all cases. Optional steps of method of use 500 are illustrated using dotted lines in FIG. 5 so as to distinguish them from the other steps of method of use 500. It should also be noted that the steps described in the method of use can be carried out in many different orders according to user preference. The use of "step of" should not be interpreted as "step for", in the claims herein and is not intended to invoke the provisions of 35 U.S.C. § 112(f). It should also be noted that, under appropriate circumstances, considering such issues as design preference, user preferences, marketing preferences, cost, structural requirements, available materials, technological advances, etc., other methods of using a lighted lamp frame device (e.g., different step orders within above-mentioned list, elimination or addition of certain steps, including or excluding certain maintenance steps, etc.), are taught herein.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A lighted lamp frame device, said device comprising:

a frame including a front, a back, a top, a bottom able to support the lighted lamp frame device above a surface, a left-side, and a right-side, with said top including a neck configured to hold a first-light-source;

at least one piece of glass removably contained within the frame;

a left-light-strip affixed to the left-side interior to the frame, the left-light strip being configured to illuminate through the at least one piece of glass;

a right-light-strip affixed to the right-side interior to the frame, the right-light-strip being configured to illuminate through the at least one piece of glass;

a power supply electrically coupled to each of the left-light-strip and the right-light-strip via a wire-assembly; and a lamp shade removably coupled to the device to provide a cover for the first-light-source;

wherein the left-side includes a left-pair of opposing channels, such that each of the left-pair of opposing channels open towards each other, and are able to removably accept one of the at least one piece of glass, such that the left-side and the at least one piece of glass define a left-chamber enclosing the left-light-strip;

wherein the right-side includes a right -pair of opposing channels, such that each of the right-pair of opposing channels open towards each other, and are able to removably accept one of the at least one piece of glass, such that the right-side and the at least one piece of glass define a right-chamber enclosing the right-light-strip; and wherein the bottom is detachable from the front, the back, the left-side, and the right-side, such that when the bottom is detached from the front, the back, the left-side, and the right-side, the left-pair of opposing channels and the right-pair of opposing channels are each exposed, enabling one or more of the at least one piece of glass to be inserted and removed from one and alternatively both of the left-pair of opposing channels and the right-pair of opposing channels.

2. The device of claim 1, wherein the power supply comprises a DC battery.

3. The device of claim 1, wherein the power supply comprises an AC power supply.

4. The device of claim 1, wherein the at least one piece of glass includes an image.

5. The device of claim 1, wherein each of the left-light-strip and the right-light-strip comprises LED lights as an LED light strip.

6. The device of claim 5, wherein the LED light strip is operated by a circuit board.

7. The device of claim 6, wherein the LED light strip is programmable via the circuit board to provide predetermined lighting patterns.

8. The device of claim 1, wherein the at least one piece of glass comprises a two-dimensional image.

9. The device of claim 1, wherein the at least one piece of glass comprises a three-dimensional image.

10. The device of claim 8, wherein the two-dimensional image is placed upon the at least one piece of glass via sub-surface engraving.

11. The device of claim 9, wherein the three-dimensional image is placed upon the at least one piece of glass via sub-surface engraving.

12. The device of claim 1, wherein the at least one piece of glass is constructed from a shatter-resistant material to provide safety and durability during use.

13. The device of claim 8, wherein the at least one piece of glass two-dimensional image comprises written functional text.

14. A lighted lamp frame device, the device comprising:

a frame including a front, a back, a top, a bottom able to support the lighted lamp frame device above a surface, a left-side, and a right-side, with said top including a neck configured to hold a first-light-source;

at least one piece of glass removably contained within the frame, said at least one piece of class including an image, said image comprising a three-dimensional image, said three-dimensional image placed upon said glass via sub-surface engraving;

a left-light-strip affixed to the left-side interior to the frame, the left-light strip being configured to illuminate through the at least one piece of glass;

a right-light-strip affixed to the right-side interior to the frame, the right-light-strip being configured to illuminate through the at least one piece of glass;

a power supply electrically coupled to each of the left-light-strip and the right-light-strip via a wire-assembly; and a lamp shade removably coupled to the device to provide a cover for the first-light-source;

a base removably coupled to the bottom of the frame;

wherein each of the left-light-strip and the right-light-strip comprise LED lights as an LED light strip, said LED light strip operable via a circuit board;

said LED light strip programmable via said circuit board to provide predetermined lighting patterns;

wherein the left-side includes a left-pair of opposing channels, such that each of the left-pair of opposing channels open towards each other, and are able to removably accept one of the at least one piece of glass, such that the left-side and the at least one piece of glass define a left-chamber enclosing the left-light-strip;

wherein the right-side includes a right -pair of opposing channels, such that each of the right-pair of opposing channels open towards each other, and are able to removably accept one of the at least one piece of glass, such that the right-side and the at least one piece of glass define a right-chamber enclosing the right-light-strip; and wherein the bottom is detachable from the front, the back, the left-side, and the right-side, such that when the bottom is detached from the front, the back, the left-side, and the right-side, the left-pair of opposing channels and the right-pair of opposing channels are each exposed, enabling one or more of the at least one piece of glass to be inserted and removed from one and alternatively both of the left-pair of opposing channels and the right-pair of opposing channels.

15. The device of claim 14, further comprising set of instructions; and wherein said device is arranged as a kit.

* * * * *